US006365813B1

(12) United States Patent
Gress

(10) Patent No.: US 6,365,813 B1
(45) Date of Patent: Apr. 2, 2002

(54) SWIVELABLE SLEEVE FOR A DRUMSTICK

(76) Inventor: Philip George Gress, 414 Sixth St., East Northport, NY (US) 11731

( * ) Notice: Subject to any disclaimer, the term of this patent is extended or adjusted under 35 U.S.C. 154(b) by 0 days.

(21) Appl. No.: 09/591,446

(22) Filed: Jun. 9, 2000

(51) Int. Cl.[7] ..... G10D 13/02
(52) U.S. Cl. ..... 84/422.4; 84/453
(58) Field of Search ..... 84/422.4, 453

(56) References Cited

U.S. PATENT DOCUMENTS 2,905,043 A * 9/1959 Soderberg ..... 84/422.4
3,859,887 A * 1/1975 Buchanan ..... 84/422.4
4,702,143 A 10/1987 Brochstein ..... 84/422.4
4,905,566 A 3/1990 Hughlett et al. ..... 84/422.4
5,477,768 A 12/1995 Swift ..... 84/453
5,503,056 A 4/1996 Evans ..... 84/422.4
5,581,031 A * 12/1996 Blankenship, Jr. ..... 84/453
6,028,260 A 2/2000 La Londe ..... 84/422.4
6,118,062 A * 9/2000 Thoman ..... 84/422.4

* cited by examiner

*Primary Examiner*—Shih-Yung Hsieh

(57) ABSTRACT

The present invention provides a swivelable sleeve for a drumstick. The swivelable sleeve is slideably attachable to a drumstick so that it changes an ordinary drumstick into a drumstick that has a pivot point. The pivot point permits the percussionist using the drumstick to reduce the friction between his/hers fingers/hands and the drumstick itself. The swivelable sleeve provides a removable frictionless point for gripping the drumstick so as to enhance the movement of the drumstick when used by a percussionist.

11 Claims, 3 Drawing Sheets

SWIVELABLE SLEEVE FOR A DRUMSTICK

BACKGROUND OF THE INVENTION

This invention relates to a swivelable sleeve that fits on a drumstick, comprising an essentially frictionless fulcrum that enables a percussionist to manipulate the drumstick with greater speed and precision than conventional drumsticks. In addition since the sleeve is removable from the drumstick, it can be positioned at any position on the drumstick that is most comfortable for the percussionist or may be removed from the drumstick all together.

DESCRIPTION OF THE PRIOR ART

It is well known in the art that numerous improvements have been made to drumsticks since their creation. For example, U.S. Pat. No. 4,702,143 issued to Irwin H. Brochstein, discloses a drumstick with a hollow portion that provides a means for producing a mellow tone quality, not otherwise present when the drumstick is used on a percussion surface.

Another patent, U.S. Pat. No. 6,028,260 issued to Anthony F. LaLonde, describes a drumstick incorporating an adjustable center of gravity for optimum balance. This drumstick contains a hollow interior containing an elongated threaded spindle that extends nearly the entire length of the drumstick. Adjustably mounted on the spindle are one or more weights that can be repositioned on the spindle to effectively adjust the balance of the drumstick.

Still another patent directed to the improvement of a drumstick is U.S. Pat. No. 4,905,566 issued to David J. Hughlett et al. that discloses a rotationally balanced drumstick. This patent discloses a drumstick having a weight, preferably a heavy weight such as a lead weight, inserted into a hole at the butt portion of the drumstick that is fixed in place. The fixed weight provides rotational balance to the drumstick.

Still yet another patent directed to an improvement to a drumstick is U.S. Pat. No. 5,477,768 issued to Donald J. Swift that discloses a multipurpose drum ball joint simulator. This patent describes a drumstick having a rubber or other elastic material ball mounted on the stick's shaft so as to provide a ball grip that fits in the palm of the percussionist's hand. This ball grip provides additional grip to the stick and thus enhances the performance of the stick.

While these devices fulfill their respective, particular objectives and requirements, the aforementioned patents do not disclose a swivelable sleeve having a means for frictionless movement that can be positioned on a drumstick so as to enable the percussionist to move the drumstick in his/her hands with less friction. In fact, the addition of weights, spindles and ball grips actually increase the friction between the hand of the percussionist and the drumstick and thus decrease the speed in which a percussionist can achieve using that drumstick.

In these respects, the swivelable sleeve of the present invention departs from the conventional concepts and designs of the prior art, and in doing so provides an apparatus primarily designed to reduce the friction between the fingers/hands of the percussionist and the drumstick.

SUMMARY OF THE INVENTION

The present invention is directed to a swivelable sleeve for a drumstick. The swivelable sleeve comprises a tubular shaft having a bore elongatively positioned throughout. The bore of the tubular shaft has a diameter large enough to slidably fit onto a standard drumstick. The sleeve is designed to fit the drumstick tightly so as not to slip when the drumsticks strike the surface of the drums. The sleeve also has first and second pivot knobs each of which has a front portion. The first and second pivot knobs are swivelably attached to the tubular shaft by first and second pivot means. The first and second pivot means terminate at a concentric wall defining the bore so as not to interfere with slipping the bore of the swivelable sleeve onto a drumstick.

The swivelable sleeve for the drumstick may have first and second knobs that may rotate 360° in an axis that is essentially perpendicular to a longitudinal axis of the tubular shaft.

The pivot point in the swivelable sleeve can be two pin shaped members that are attached to the first and second knobs independently. The first pin extends from the outside surface of the first knob, through the first knob and through the wall of the swivelable sleeve terminating at the surface of the concentric wall defining the bore. The second pin extends from the outside surface of the second knob in the same fashion as in the first knob. The second knob is positioned 180 degrees from the first attachment on the outer surface of the swivelable sleeve. The first and second pins have a circular cross-section.

This connection permits the swivelable sleeve to be attached to a drumstick. Once attached to the drumstick, the swivelable sleeve enables a percussionist to move the drumsticks about the pivot points so that the first end of elongated tubular body of the drumstick moves in an opposite direction of the front portion of the swivelable sleeve. In other words, when the front portion of the swivelable sleeve moves above the longitudinal axis of the elongated tubular body of the drumstick, the first end of the swivelable sleeve moves below the longitudinal axis of the elongated tubular body of the drumstick. Accordingly, when the front portion of the pivot means of the swivelable sleeve moves below the longitudinal axis of the elongated tubular body of the drumstick, the first end of the swivelable sleeve moves above the longitudinal axis of the elongated tubular body of the drumstick.

A rapid succession of these positions, i.e., above the longitudinal axis of the elongated tubular body to below the longitudinal axis of the elongated tubular body, allows the percussionist to move the drumstick in a rapid movement with reduced or no friction between the fingers/hands of the percussionist and the drumsticks.

In another embodiment of the invention, the swivelable sleeve further comprises an expandable cuff member mounted on the tubular shaft. The expandable cuff member is used to secure the swivelable sleeve to the drumstick. The fact that the cuff is expandable allows the percussionist to slide the sleeve up and down the drumstick to a comfortable position regardless of the diameter of the drumstick. Once the sleeve is positioned at a desired point, the expandable cuff is locked so as to tightly secure the sleeve to the drumstick.

In another embodiment, the expandable cuff of the swivelable sleeve comprises a lever that adjusts the diameter of said expandable cuff so that when the swivelable sleeve is slid onto a drumstick to a desired position the lever is adjusted to tightly close the cuff about the drumstick. Once closed the swivelable sleeve holds tightly in place.

In another embodiment the swivelable sleeve is made of rubber, plastic, metal mesh or a synthetic material having a memory.

DETAILED DESCRIPTION OF THE INVENTION

Figure 1A:
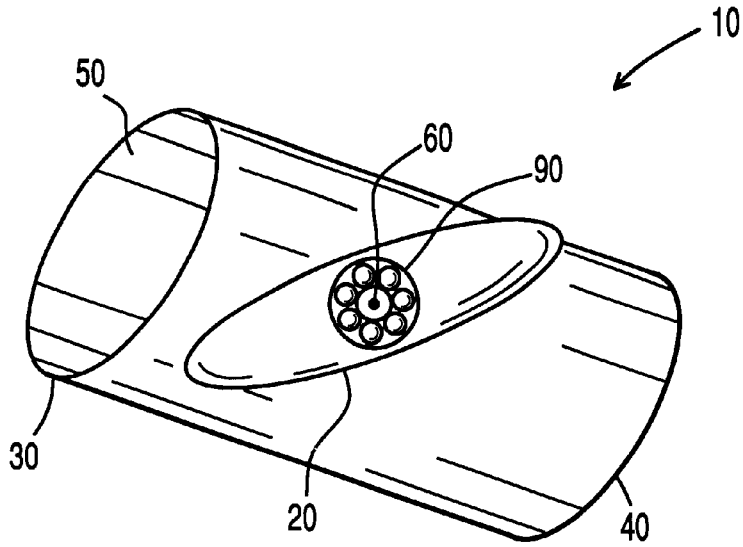
FIG. 1A is a longitudinal view the swivelable sleeve wherein the front portion is in the up position.

Referring to the accompanying figures, FIG. 1A illustrates a swivelable sleeve 10 for a drumstick incorporating one embodiment of the present invention. The swivelable sleeve 10 has an elongated tubular body with a front portion 30 and a rear portion 40 located at opposite longitudinal ends of the elongated tubular body.

An integral part of the swivelable sleeve 10 of the present invention is a pivot means. The pivot means comprises a first pivot pin 60 and a second pivot pin 80. The first and second pivot pins are attached to the concentric wall 50 of the swivelable sleeve 10 at positions that are 180 degrees from one another when measured along the surface of the swivelable sleeve. The pivot pins have a circular cross section and move freely in the hole bored in the concentric wall of the swivelable sleeve 10 (not shown).

Attached to the first pivot pin 60 is a first pivot knob 20. The first pivot pin goes through the concentric wall 50 of the swivelable sleeve 10 where it terminates at a pivot head 65 (shown in FIG. 2A). The pivot head 65 is recessed into the concentric wall 50 so that it does not interfere with the slidability of the swivelable sleeve on to a drumstick.

Attached to the second pivot pin 80 is the second pivot knob 70. The second pivot pin 80 and pivot knob 70 are attached the same way as the first pivot pin 60 and pivot knob 20 are attached to the swivelable sleeve. The first and second pivot knobs can be circular, elongated or any other ergonomic configuration.

The above embodiments of the present invention provide a swivelable sleeve that when slid on to and attached to a drumstick, enables a percussionist to firmly grip the drumsticks, but at the same time reduces the friction between the percussionist's fingers/hands and the drumsticks. When a percussionist's grips a standard drumstick without the swivelable sleeve, a fulcrum is created, i.e., a pivoting point. However, in order to maintain control of the drumstick while playing, the percussionist must grip the drumstick firmly in his/hers fingers/hands. This creates friction between the fingers/hands of the percussionist and the drumsticks and that reduces movement of the drumsticks.

The swivelable sleeve of the present invention provides a mechanism that enables the percussionist to firmly grip the drumstick in his/hers hands so as to maintain control of the drumstick but at the same time reduce the friction between the drumstick and the fingers/hands of the percussionist. When the percussionist grips the first and second pivot knobs of the swivelable sleeve in his/her hands, these pivot knobs pivot in a seesaw motion about the axis of the pivot pins to which they are attached. This motion is smooth and frictionless. As the front portion 30 of the swivelable sleeve moves in the downward direction, the first end of the drumstick to which the sleeve is attached moves in the upward direction. Accordingly, as the front portion 30 of the swivelable sleeve moves in the upward direction, the first end of the drumstick moves in the downward direction.

A rapid repetition of the seesaw motion of the pivot means enables the percussionist to increase the speed in which he/she moves the drumsticks while maintaining a firm grip on the drumsticks.

Figure 1B:
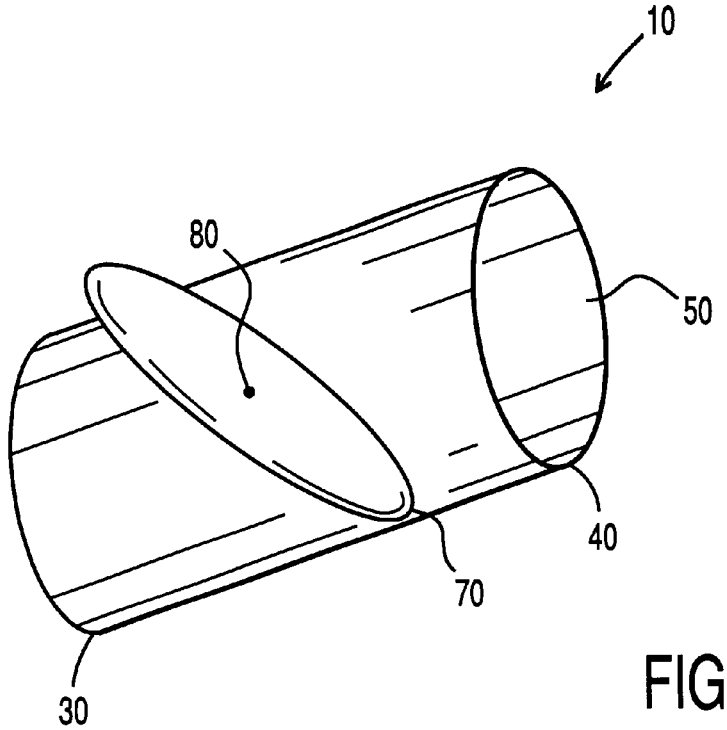
FIG. 1B is a longitudinal view the swivelable sleeve wherein the front portion is in the down position.

FIG. 1B shows all of the elements shown in FIG. 1A, except the front portion 30 of the swivelable sleeve 10 is tilted in the downward position and therefore the first end of the drumstick to which it is attached would be tilted in the downward direction, thus illustrating the see-saw movement explained above.

Figure 2A:
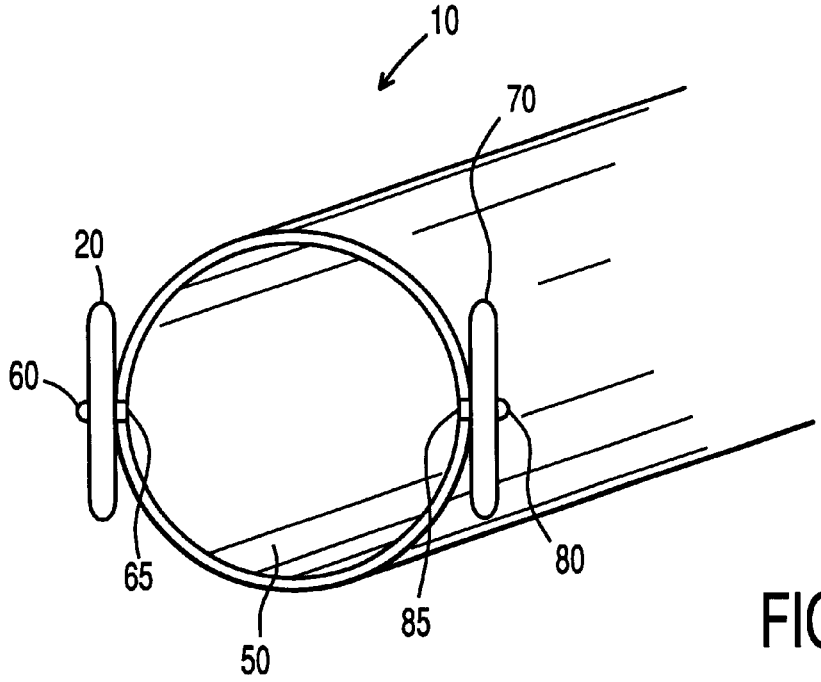
FIG. 2A is a cross section of the swivelable sleeve.

FIG. 2A illustrates a cross section of the swivelable sleeve of FIGS. 1A and 1B. In this figure, first and second pivot knobs 20 and 70 are attached to the concentric wall 50 of the swivelable sleeve 10 by first and second pivot pins 60 and 80. The first pivot knob 20 is attached to the concentric wall 50 by the first pivot pin 60. The first pivot pin 60 has an inside head 65 that is positioned in the recessed cavity in the concentric wall 50 so as not to come in contact with the drumstick once it is inserted into the swivelable sleeve. This arrangement is important to allow for easy attachment of the swivelable sleeve to the drumstick.

On the opposite side of the swivelable sleeve (180 decrees away) the second pivot knob is attached to the swivelable sleeve. The second pivot knob 70 is attached to the sleeve by pivot pin 80. As with the first pivot pin, the second pivot pin 80 has a pivot head 85 that is positioned in the recessed cavity in the concentric wall 50.

The concentric wall 50 defining the bore in which a drumstick is inserted, may be lined with Teflon® or a Teflon®-like material so as to allow for easy attachment of the swivelable sleeve to the drumstick. Likewise, the hole of the concentric wall in which the first and second pivot pins extend through, may also be lined with Teflon® or a Teflon®-like material so as to allow for frictionless motion between the pivot pins and the swivelable sleeve. Teflon® or a Teflon®-like material may be used between the pivot knobs and outer wall 50.

In another embodiment, the hole in the concentric wall in which the first and second pivot pins extend through may be lined with a plurality of ball bearing units that are axially retained and concentrically connected to the pivot pins 60 and 80 so as to reduce the friction between the pivot pins and the surface of the concentric wall of the hole.

Figure 2B:
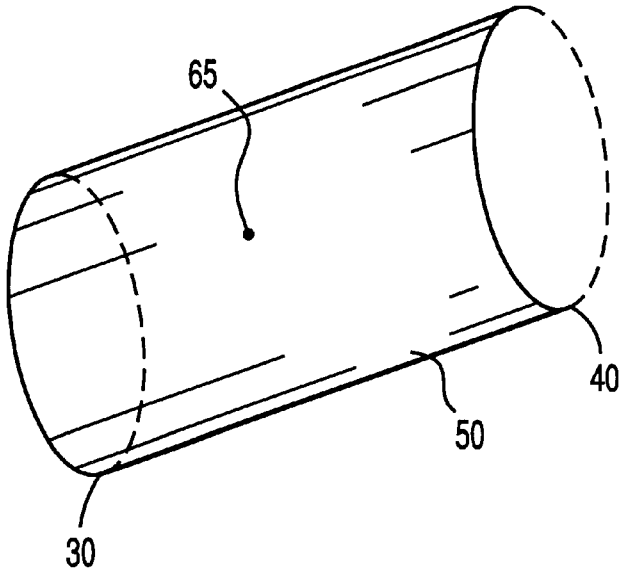
FIG. 2B is a longitudinal cross section of the swivelable sleeve.

FIG. 2B is a longitudinal cross-section of the swivelable sleeve showing the concentric wall with the inside head of the first pivot pin recessed within the concentric wall.

Figure 3A:
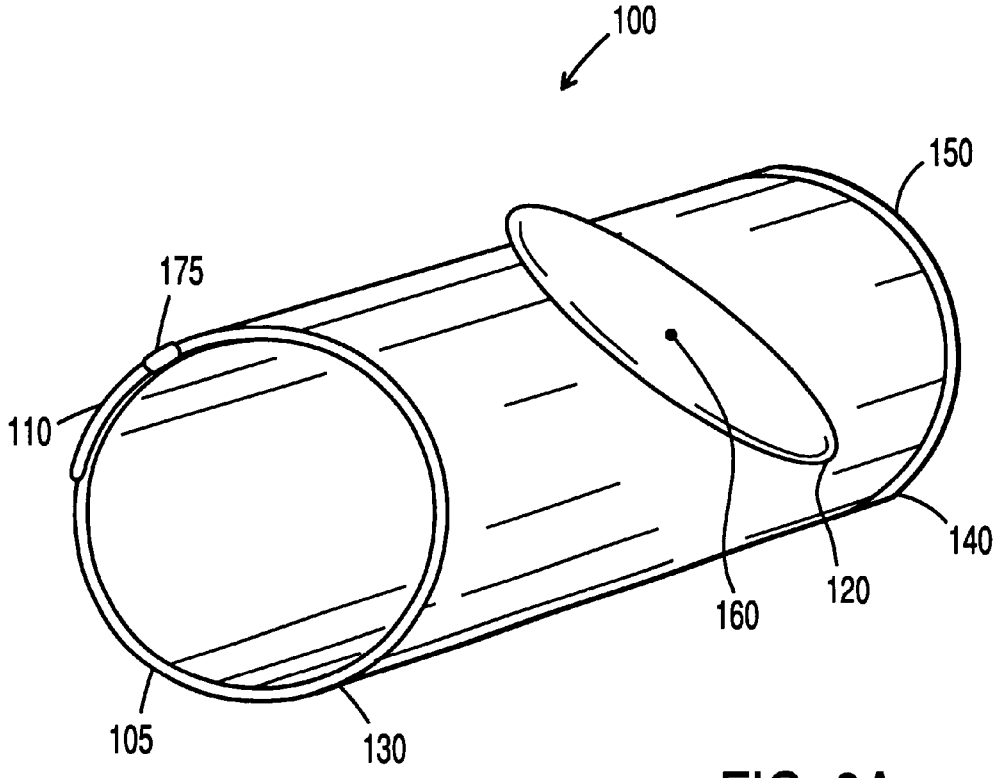
FIG. 3A is a longitudinal view the swivelable sleeve having expandable cuff.
Figure 3B:
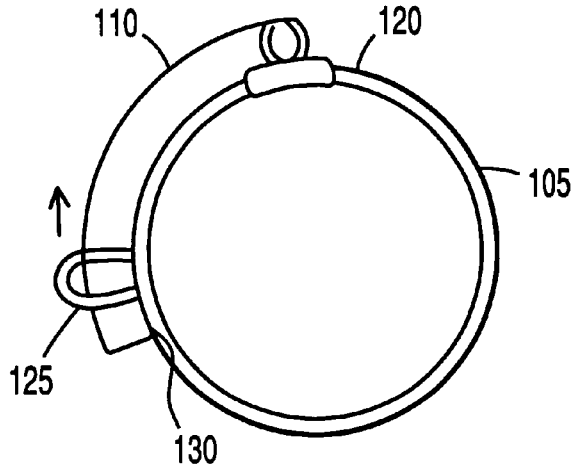
FIG. 3B is a cross section of the expandable cuff.

In another embodiment of the invention, the swivelable sleeve is equipped with an expandable cuff as shown in FIG. 3A. FIG. 3A shows a swivelable sleeve 100 having a first pivot knob 120 attached to the sleeve by a pivot pin 160 and a second pivot knob and pin (not shown) that is attached to the swivelable sleeve 180 degrees away. At the front and rear of the swivelable sleeve are expandable cuffs 105 and 140. The front expandable cuff 105 has a lever 110 that adjusts the expandable cuff and a slide 175 that allows the expandable cuff to expand and contract. A second expandable cuff 150 may be positioned at the rear of the swivelable sleeve 140 for added stationability.

When the expandable cuffs are in the open position, the swivelable sleeve can be slid onto the drumstick and positioned at a desired place. Once the sleeve is positioned at a desired place, the levers of the expandable cuffs can be closed so as to press the cuffs tightly against the surface of the drumstick. Once the levers are closed the swivelable sleeve is securely attached to the drumstick, the drumstick is converted in to a drumstick having a frictionless pivot point.

FIG. 3A shows the front expandable cuff of FIG. 3A in an enlarged view. The front expandable cuff 105 has a lever 110 that can be pushed back to open the expandable cuff. When in the open position the cuff has a larger opening than when in the closed position therefore allowing a drumstick to be easily positioned in the swivelable sleeve. When the lever is closed and the opening of the expandable cuff is reduced, the lever is locked in place by snap lock 125. Snap lock 125 can be attached to the expandable cuff by a hinge so that it can be moved forward and positioned over the lever to prevent the lever from opening. In the alternative, the snap lock can be attached to a slide that allows the snap lock to push forward into a position that the lever can be locked in place. When the lever is to be placed into the opened position, the snap lock can be slid back to a position where it does not touch the lever.

The swivelable sleeve described herein can be made from synthetic materials capable of memory, rubber or rubber-like materials or any other material that is able to tightly fit onto a drumstick. For example, the swivelable sleeve can be made of rubber, neoprene, polyurethane or other strong material with a memory.

In connection with the various forms of the invention shown here, it is readily visualized that numerous modifications to the concept herein disclosed, may be adopted without departing from the spirit and scope of the invention as set forth.

What is claimed is:

1. A swivelable sleeve for a drumstick comprising:

a tubular shaft having a longitudinal bore, said bore of said tubular shaft having a diameter large enough to slideably fit onto a drumstick;

a first pivot knob and a second pivot knob having a front portion, said first and second pivot knobs being swivelably attached to the tubular shaft by a first and second pivot means provided that said first and second pivot means end at a concentric wall defining said elongated bore; and wherein once said swivelable sleeve is in attached to a drumstick, a front portion of said drumstick moves in an opposite direction compared to a front portion of said tubular shaft.

2. A swivelable sleeve for a drumstick according to claim 1, wherein said first and second pivot knobs are attached to opposite sides of said tubular shaft by said pivot means.

3. A swivelable sleeve for a drumstick according to claim 2, wherein said first and second pivot means are pins, each of said pins having a circular cross-section and extends through said first and second pivot knobs and through the concentric wall of the tubular shaft provided that said pins terminate at said concentric wall defining said elongated bore.

4. A swivelable sleeve for a drumstick according to claim 3, further comprising a plurality of ball bearing units being axially retained and concentrically connected to said pivot pins, said plurality of ball bearing units allowing the pivot pins to rotate about said pins attached to said pivot knobs.

5. A swivelable sleeve for a drumstick according to claim 1, wherein the pivot knobs move about the pivot pins in a substantially frictionless manner.

6. A swivelable sleeve for a drumstick according to claim 1, wherein said swivelable sleeve is made of and elastic material having a memory.

7. A swivelable sleeve according to claim 6, wherein said swivelable sleeve is made of rubber, plastic, metal mesh or a synthetic material having a memory.

8. A swivelable sleeve according to claim 1, further comprising an expandable cuff member mounted on said tubular shaft.

9. A swivelable sleeve for the drumstick according to claim 8, wherein said expandable cuff member has a diameter large enough to slideably fit onto a drumstick.

10. A swivelable sleeve for the drumstick according to claim 9, wherein said expandable cuff comprises an adjustable lever that adjusts the diameter of said expandable cuff so that when said swivelable sleeve is slide onto a drumstick said adjustable lever closes tightly about the drumstick so as to fasten the swivelable sleeve in place.

11. A swivelable sleeve for a drumstick according to claim 1, wherein said first and second knobs rotate 360° in an axis that is essentially perpendicular to a longitudinal axis of the tubular shaft.

* * * * *